United States Patent [19]

Brown et al.

[11] 4,271,927

[45] Jun. 9, 1981

[54] INSPECTION OR MAINTENANCE CRADLE

[75] Inventors: George S. Brown, Sawbridgeworth; Robert E. Hatton, Great Bardfield, both of England

[73] Assignee: Riggers (Steeplejacks) Limited, Essex, England

[21] Appl. No.: 44,780

[22] Filed: Jun. 4, 1979

[51] Int. Cl.[3] ..... E04G 3/16

[52] U.S. Cl. ..... 182/36; 182/150; 248/324; 105/154

[58] Field of Search ..... 182/36, 150; 105/154; 248/323, 324

[56] References Cited

U.S. PATENT DOCUMENTS

| | | | |
|---|---|---|---|
| 2,522,654 | 9/1950 | Wamsley | 105/154 |
| 2,645,187 | 7/1953 | Gaudagna | 105/154 |
| 2,761,396 | 9/1956 | Harlan | 182/36 |
| 2,925,240 | 2/1960 | Laviolette | 182/36 |
| 2,980,384 | 4/1961 | Leonard | 182/36 |
| 3,394,776 | 7/1968 | Abrams | 182/36 |
| 3,945,462 | 3/1976 | Griswold | 248/324 |

*Primary Examiner*—Reinaldo P. Machado

*Attorney, Agent, or Firm*—Shlesinger, Arkwright, et al.

[57] ABSTRACT

A suspended cradle for use in the inspection and maintenance of difficulty accessible structures comprises a frame provided with a series of at least three roller assemblies each having rollers for running on an overhead track on the structure to be inspected or maintained and thereby suspending the frame for movement along the track. Each roller assembly has means for rendering the roller assembly inoperative by relieving the load on the rollers and withdrawing the rollers from the track so that the inoperative roller assembly can move past an obstruction on the track while the frame remains movably supported on the track by the remaining roller assemblies.

10 Claims, 12 Drawing Figures

7
X
66
82
27
77
78
117
79
Y
77
78
76
71
73
70
80
69
68
96
95
67
98
99
90
92
100
105
119
93

INSPECTION OR MAINTENANCE CRADLE

BACKGROUND OF THE INVENTION

This invention relates to improvements in suspended cradles for use in the inspection and maintenance of difficulty accessible structures.

Known suspended cradles used for these purposes comprise a caged platform which is suspended and moved on cables. Whilst these known cradles have been developed so that, with skillful use, they are satisfactory in enabling many difficult inspection and maintenance tasks to be carried out, there are environments, such as the underneath of an off-shore oil production platform, where it is difficult and hazardous to install and operate such cable type cradles. In the case of the underneath of an oil production platform, this is because of the relatively restricted space between the underneath of the platform and the surface of the sea, the activity of the sea itself and the numerous obstructions in the form of pipes, beams and the like encounted beneath the platform.

It is an object of the present invention to provide an improved suspended cradle which is suitable for use in the inspection and maintenance of difficulty accessible structures such as off-shore oil production platforms.

SUMMARY OF THE INVENTION

Accordingly, the present invention provides a suspended cradle including a frame provided with roller assemblies each having rollers for running on a track on the structure to be inspected or maintained and thereby suspending the frame for movement along the track, each roller assembly having means for rendering the roller assembly inoperative by relieving the load on the rollers and withdrawing the rollers from the track so that the inoperative roller assembly can move past an obstruction on the track whilst the frame remains movably supported on the track by the remaining roller assemblies.

Each roller assembly may comprise a pair of rollers each for engaging a respective horizontal flange of an inverted T-shaped rail forming the said track, each roller being mounted on a carrying arm which is vertically displaceable relative to the frame for relieving the load on the roller and pivotably mounted on the frame for withdrawing the roller transversely of the rail.

In one embodiment of the invention, the carrying arms of a roller assembly are pivotally connected on a load-relieving member which is vertically displaceable with respect to a stationary base member fixed to the frame for relieving the load on the rollers.

Between the pivotal connection to the load-relieving member and the roller, each carrying arm may be provided with a sliding block articulated to a fixed lever carried by a movable arm-pivoting member which is mounted on the load-relieving member for vertical displacement relative thereto in order to pivot the carrying arm about its pivotal connection to the load-relieving member and thereby withdraw the roller from the rail.

In another embodiment of the invention said carrying arms of each said roller assembly are pivotally connected together by a pivot link, and a lever mechanism is provided for displacing said pivot link in order to release said rollers from the track.

Said carrying arms of each roller assembly may extend into a recess in a base member fixed to said frame, said carrying arms being connected together in said base member recess by said pivot link which is captively retained in a slot extending through said base member for movement between a roller-applying position and a roller-releasing position, said base member recess having internal cam surfaces which pivot said carrying arms towards one another as said pivot link is moved from said roller-releasing position to said roller-applying position.

Desirably, locking means are provided for locking said carrying arms of each roller assembly together in the position of said carrying arms applying said rollers to the track.

An inspection cradle embodying the invention may comprise first and second vertical frames for suspension alongside one another from respective first and second parallel tracks on the structure to be inspected, and flooring extending between and supported by the two frames.

A maintenance cradle embodying the invention may comprise a first pair of vertical frames for suspension in spaced apart relationship from a first track on the structure to be maintained, a second pair of vertical frames for suspension alongside the first pair of frames in spaced apart relationship from a second parallel track on the structure, and flooring extending between and supported by the four frames.

Preferably, each vertical frame is of ladder-like construction having a plurality of vertically spaced apart horizontal bars for supporting flooring so that flooring may be supported between two frames in a substantially level condition when the frames are suspended from tracks at different heights.

In order that the invention may be readily understood, embodiments thereof will now be described, by way of example, with reference to the accompanying drawings, in which.

Figure 1:
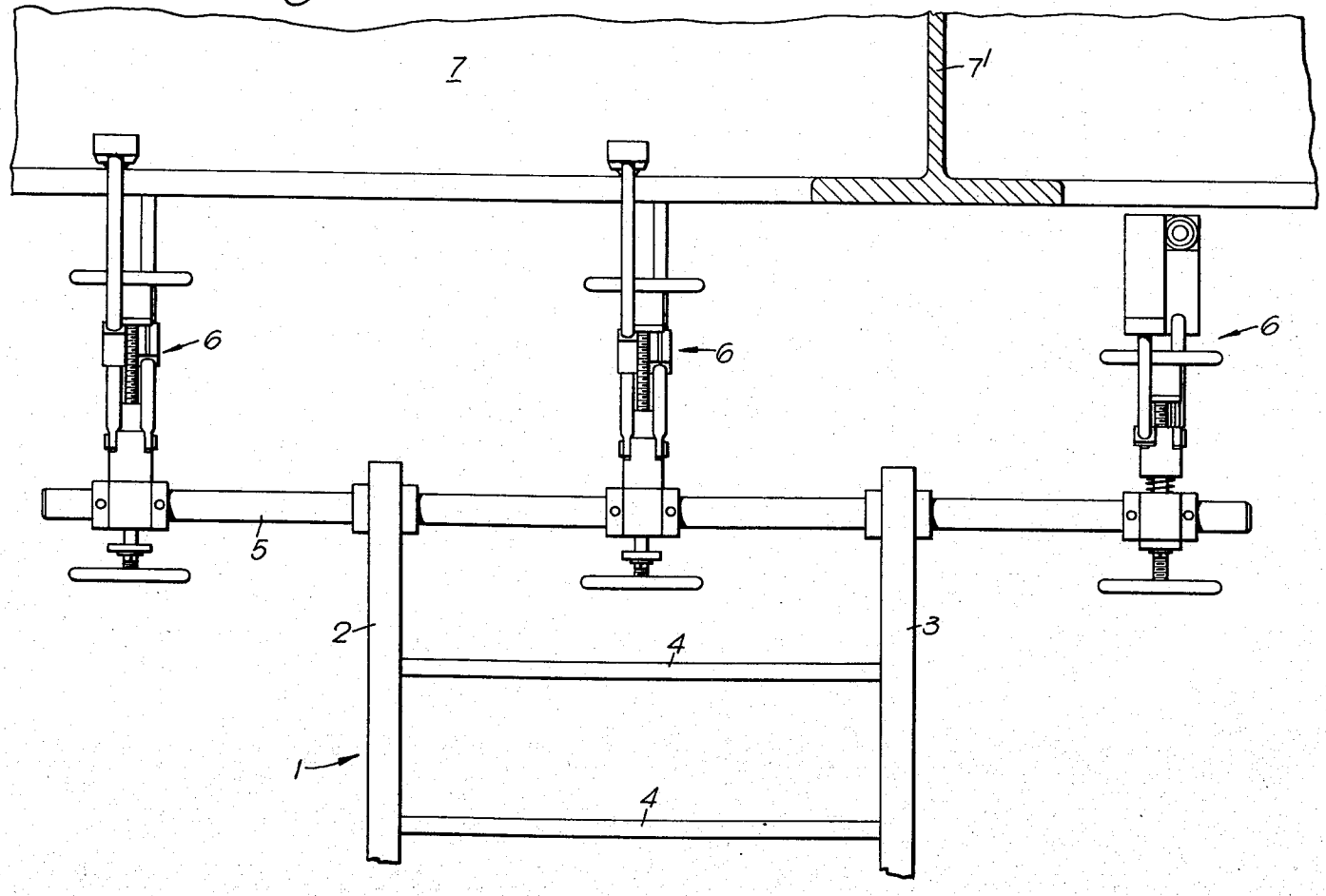
FIG. 1 is a fragmentary side elevation of a vertical frame of a suspended cradle embodying the invention.

Referring to FIG. 1, a suspended cradle embodying the invention includes a ladder-like vertical frame 1 comprising a pair of uprights 2 and 3 interconnected by horizontal crossbars 4. A horizontal suspension rod 5 is secured to the top of the frame 1 and is longer than the crossbars 4 so that it projects beyond the uprights 2 and 3 of the frame. Three roller assemblies 6 are fixed on the suspension rod 5 at spaced apart intervals therealong and serve to suspend the frame 1 from an inverted T-shaped rail 7, so that the frame is movable along the rail which may be formed, for example, by a lower part of an RSJ of the structure with which the cradle is to be used. In the event of an obstruction, such as the transverse beam 7' shown in FIG. 1, the roller assemblies 6 can be individually disengaged from the rail 7, so that they can each in turn be moved past the obstruction, whilst the cradle remains safely suspended by the remaining roller assemblies.

Figure 3:
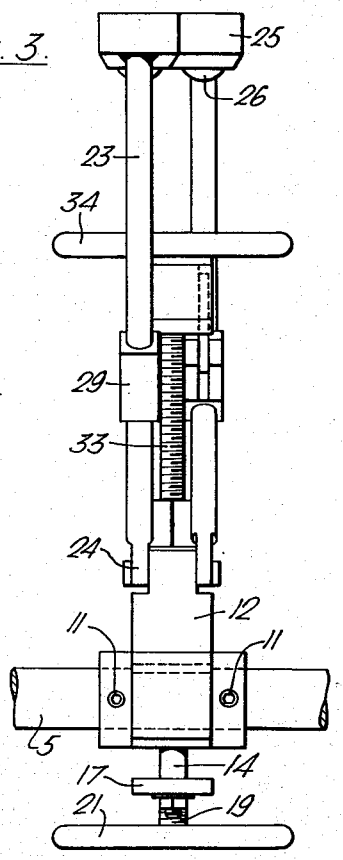
FIG. 3 is a side view of the roller assembly of FIG. 2.
Figure 2:
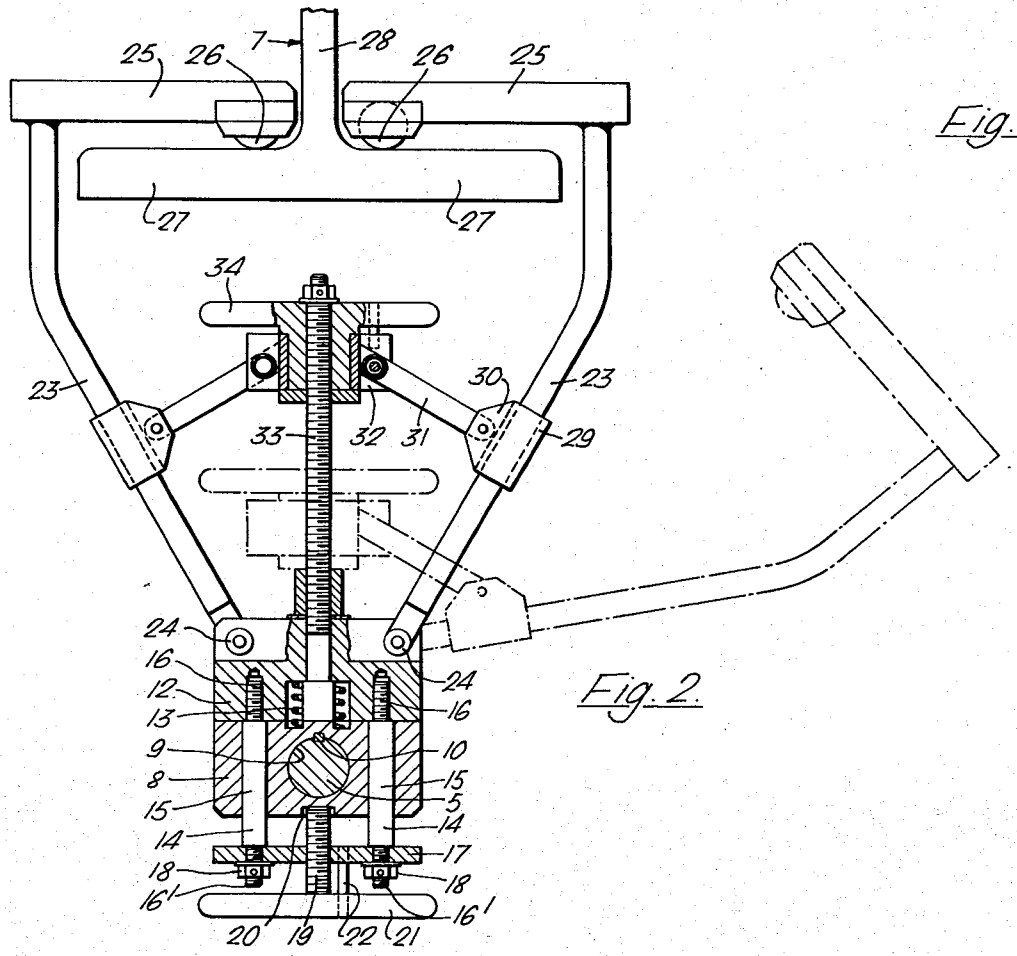
FIG. 2 is an enlarged end view, partly in vertical section of a roller assembly of the frame shown in FIG. 1.

FIG. 2 and 3 show the detailed construction of a foller assembly 6. As shown in these Figures, each roller assembly comprises a mounting block 8 having a bore 9 through which the suspension rod 5 extends, the block 8 being keyed on the suspension rod 5 against angular movement by a key 10 and against longitudinal movement by bolts 11.

A load-relieving block 12 is disposed on the mounting block 8 and is normally drawn down against the block 8 against the force of a spring 13 by draw bolts 14 which having plain portions 15, extending freely through bores in the mounting block 8 and threaded portions 16 screwed into the load-relieving block 12. Threaded tails 16 of the draw bolts 14 extend through apertures in a draw plate 17 and are secured therein by nuts 18. The draw plate 17 is threadedly engaged on a threaded shaft 19 journalled at 20 in the mounting block 8 and provided with a pressure-relieving handwheel 21. A safety pin 22 engaging in the draw plate 17 is provided to lock the handwheel against inadvertent rotation.

Two carrying arms 23 are pivotally connected at one end 24 to the load-relieving block 12, the connections of the two arms being made on opposite vertical end surfaces of the block 12 so that the arms lie in vertical planes which are spaced apart in the direction of movement of the frame 1 along rail 7. The arms 23 present at their top ends oppositely extending roller bars 25 provided with rollers 26 for running on respective horizontal flanges 27 of the rail 7 which are separated by a vertical web 28 of the rail.

Between the roller bar 25 and the pivotal connection 24 each arm 23 carries a sliding block 29 having a pair of parallel ears 30 between which is articulated one end of a respective lever 31. The other end of the lever 31 is fixed to a carrier 32 which is displaceable along a threaded rod 33 between an upper position (shown in full line in FIG. 2) and a lower position (shown in dashed lines) by rotation of a second handwheel 34. A safety pin 35 for locking the handwheel 34 and carrier 32 against relative rotation is provided to prevent inadvertent rotation of the handwheel.

The full line drawing of FIG. 2 shows the roller assembly in its working condition with rollers 26 engaged on the flanges 27 of the rail 8. To disengage the assembly from the rail 7, the handwheel 21 is first operated to displace the draw plate 17 and drawbolts 15 upwardly so that the load relieving block 12 is lifted relative to the mounting block 8, thereby relieving the load on the rollers 26. The handwheel 34 is then operated to displace the carrier 32 downwardly so as to pivot the arms 23 apart and into their lowered position shown in dashed lines in FIG. 2.

Figure 4:
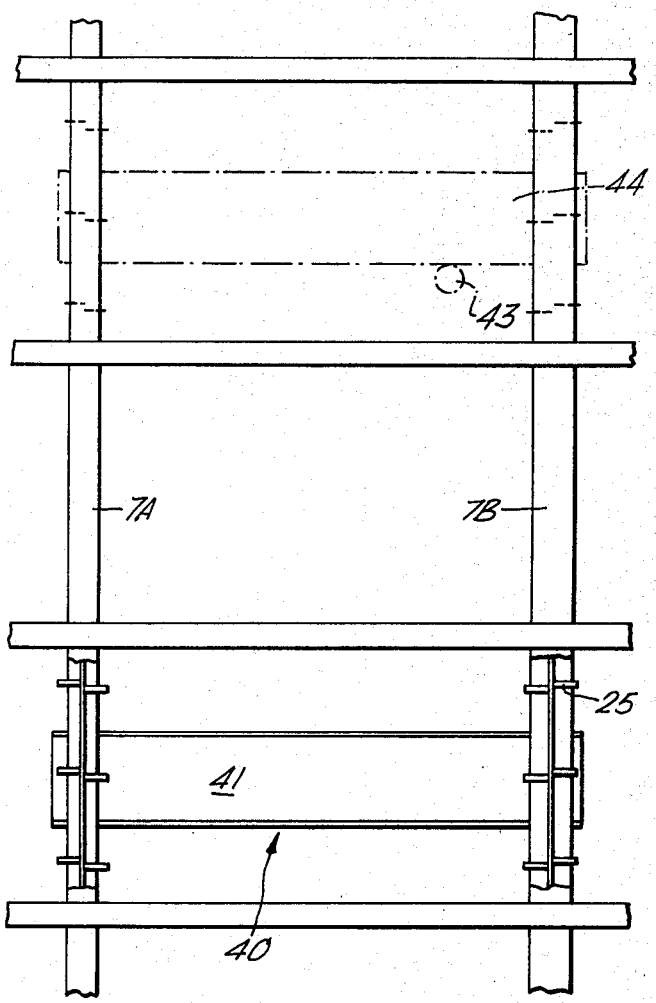
FIG. 4 is a schematic plan view of a suspended inspection cradle embodying the invention.
Figure 5:
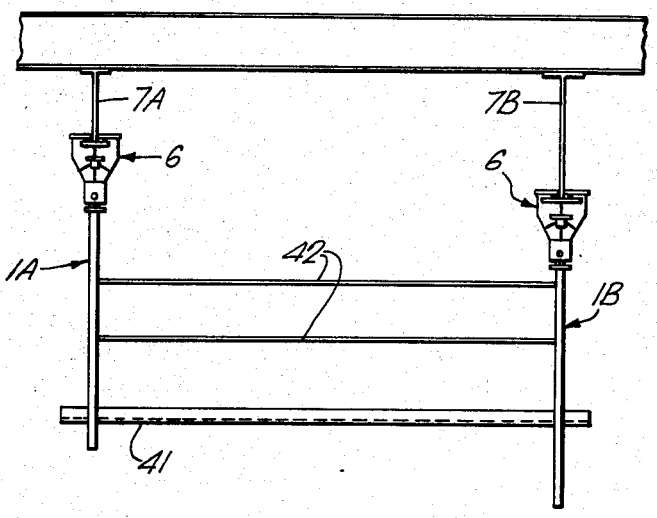
FIG. 5 is an end view of the inspection cradle of FIG. 4.
Figure 6:
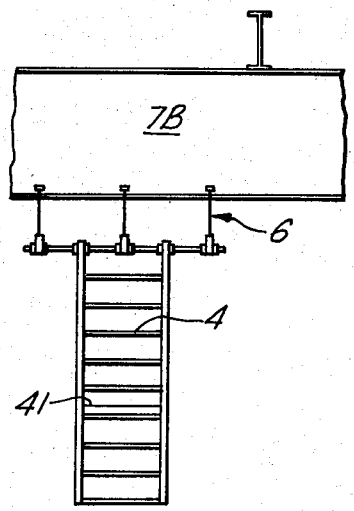
FIG. 6 is a side view of the inspection cradle of FIG. 4.

FIGS. 4 to 6 show a suspended inspection cradle 40 which is constituted by first and second vertical frames 1A and 1B as described with reference to FIG. 1. The frames 1A and 1B each have three roller assemblies 6 as described with reference to FIGS. 2 and 3 and are thereby suspended from respective first and second parallel rails 7A and 7B on a structure to be inspected. A horizontal platform 41 extends between respective crossbars 4 of the frames 1A and 1B and is secured to the crossbars, for example by suitable clips. As shown in FIGS. 5 and 6, the flanges of rails in which the roller assemblies 6 roll may lie at different heights, the platform 41 being supported between crossbars 4 of the frames 1A and 1B which lie at substantially the same horizontal level. Safety rails 42 extend between the uprights of the frames 1A and 1B, so that the platform is enclosed. The cradle 40 can be moved along the rails 7A and 7B so that the structure above the cradle can be progressively inspected. When obstructions are encountered in the rails, each roller assembly affected by the obstruction can be disengaged from the rail, moved beyond the obstacle and then re-engaged to enable the next roller assembly to be moved past the obstruction. Throughout the negotiation of obstacles each frame 1A or 1B always has at least two roller assemblies 6 maintained in engagement with the rail and thus remains stably suspended. Moreover, the staggering of the rollers 26 of each assembly 6 in the direction of motion means that each frame is always suspended from four spaced apart points on the rail during movement past an obstacle.

FIG. 4 illustrates the use of cradle 40 in a structure where the movement of the cradle 40 along the rails 7A and 7B is assumed to be limited by a vertically extending obstruction, such as a pipe 43 which is located between rails 7A and 7B. In this event, a second cradle 44 may be provided on the rails 7A and 7B beyond the obstruction 43 to enable inspection to be carried out along rails 7A and 7B beyond obstruction 43.

Figure 7:
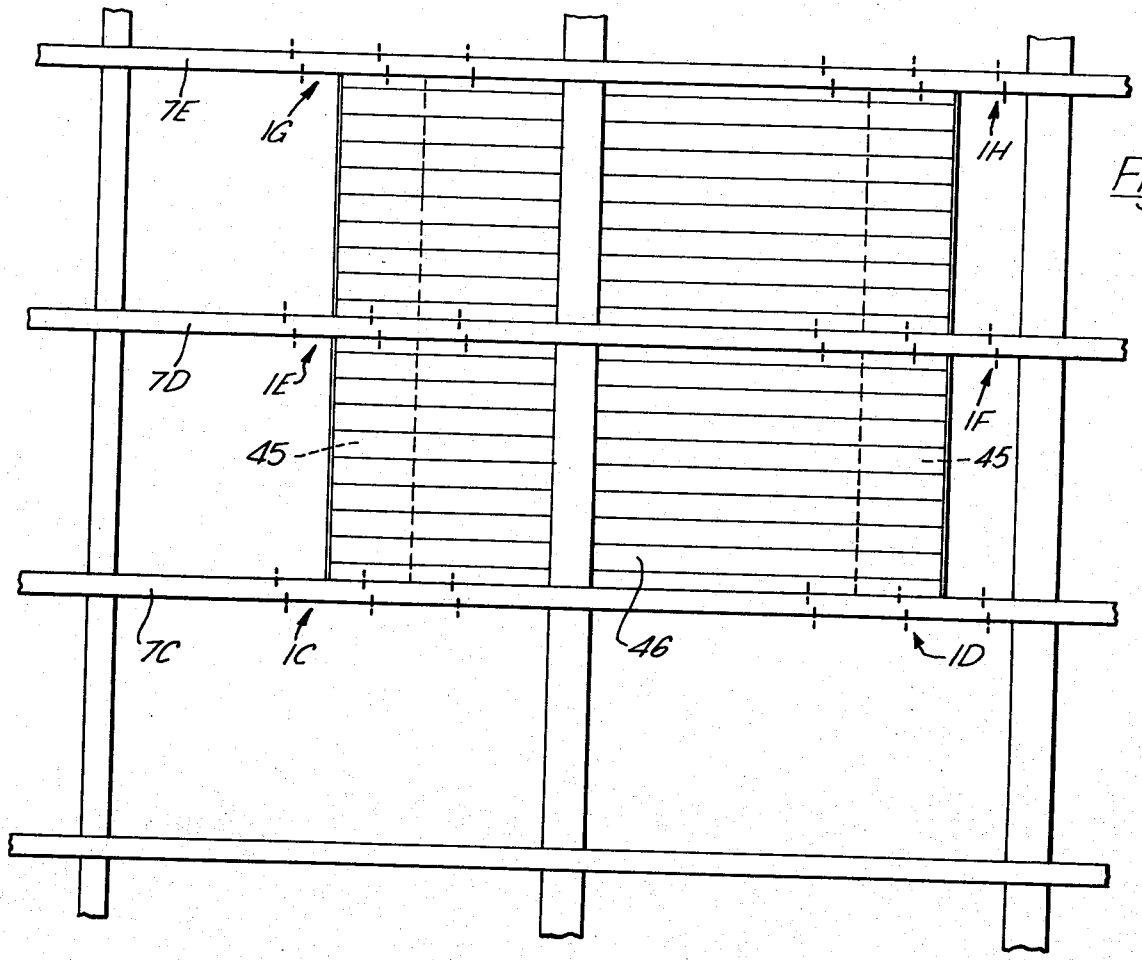
FIG. 7 is a schematic plan view of a suspended maintenance cradle embodying the invention.
Figure 8:
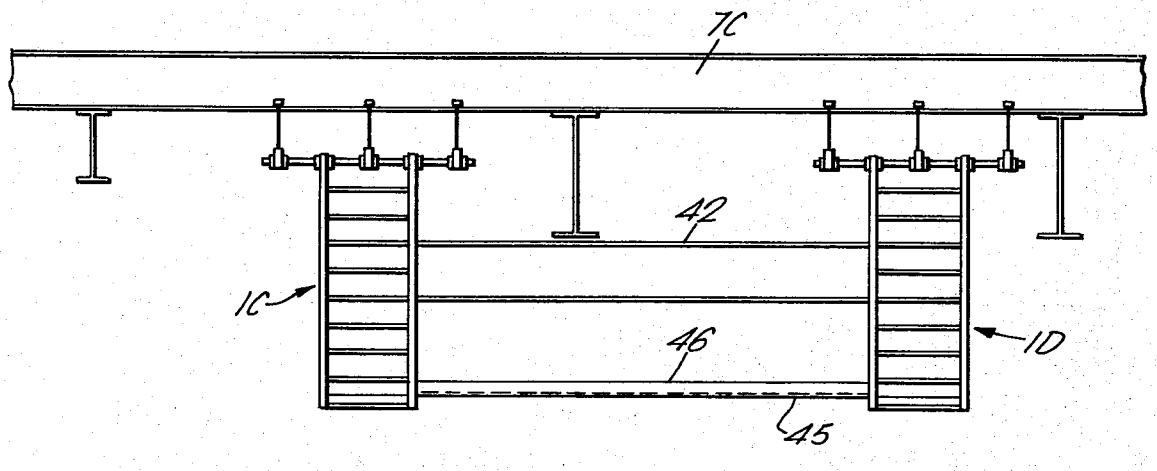
FIG. 8 is a side view of the maintenance cradle of FIG. 7.

Referring to FIGS. 7 and 8, a maintenance cradle embodying the invention comprises a first pair of frames 1C and 1D as described with reference to FIGS. 1 to 3 suspended in spaced apart relationship in a first rail 7C on the structure to be maintained and a second pair of frames 1E and 1F for suspension alongside the first pair of frames in spaced apart relationship in a second rail 7D parallel to rail 7C. The corresponding frames 1C and 1E of each pair are connected together by platform strips 45 between which is fixed cross boarding 46 to rigidly join the four frames together. If desired, a third pair of frames 1G and 1H suspended from a third parallel rail 7E may be rigidly connected to the four frames 1C to 1F to provide a wider cradle. As in the case of the inspection cradle 40, the rails 7D to 7E may be at different heights below the structure to be maintained, and suitable cross-bars of the frames selected to give a horizontal working platform. Safety rails 42 may also be provided.

Various modifications may be made in the above described embodiments of the invention. For example, although the rollers 26 are shown as being spherical, they may be cylindrical rollers mounted for rotation about an axis parallel to the arms 25.

FIGS. 9 to 12 show the detailed construction of a second form of roller assembly 66 for a cradle embodying the invention. As shown in these Figures each roller assembly comprises a mounting block 67 having a bore 68 for receiving the suspension rod 5 (FIGS. 2 and 3), the block 67 being keyed on the suspension rod by a key received in keyway 69 and in a matching keyway in the rod.

The mounting block 67 is constructed from two platelike members 70, 71 of matching outline and riveted or otherwise secured together. The members 70, 71 having their inner abutting surfaces recessed to define in the block 67 a recess 72 having a central vertical full thickness channel 73 and two lateral reduced thickness channels 74, 75. Each channel 74, 75 extends to the top and respective side of the block 67 and has its lower extremity defined by an upwardly and outwardly curving cam surface 76 extending from the bottom of the central channel 73.

Two carrying arms 77, 78 have lower ends thereof received in the recess 72. Lower straight end portions 79 of the arms are received side-by-side in the central channel 73 of the recess 72 with the arms extending outwardly in opposite directions through the respective side channels 74, 75. The free ends of the arm portions 79 in the channel 73 are pivotally connected together by a pivot pin 80 which extends through the block 67 and is captive in a vertical slot 81 extending through the block 67 along the central channel 73. At their upper ends each carrying arm 77, 78 carries a roller 82 for running on respective horizontal flanges 27 of the overhead rail 7.

The pivot pin 80 is connected to a lever system 90 for moving the pivot pin between a lower roller-applying position (shown in full lines in FIG. 9) in which the carrying arms 77 and 78 are closed together and the roller 82 are applied to the rail 7 and a roller-releasing position (shown in dashed lines in FIG. 9) in which the carrying arms 77, 78 are opened away from one another and the rollers 82 are disengaged from the rail 7. Arrow X indicates the upwards and outwards movement of the rollers 82 as pivot pin 80 is displaced upwardly and arrow Y indicates the downward movement of the arms 77, 78 as they pivot outwardly as the pin 80 is displaced.

For safety, the arms 77, 78 are locked together in the roller-applying position by a spring-loaded safety locking device 83 which will be described in more detail hereinafter.

Figure 9:
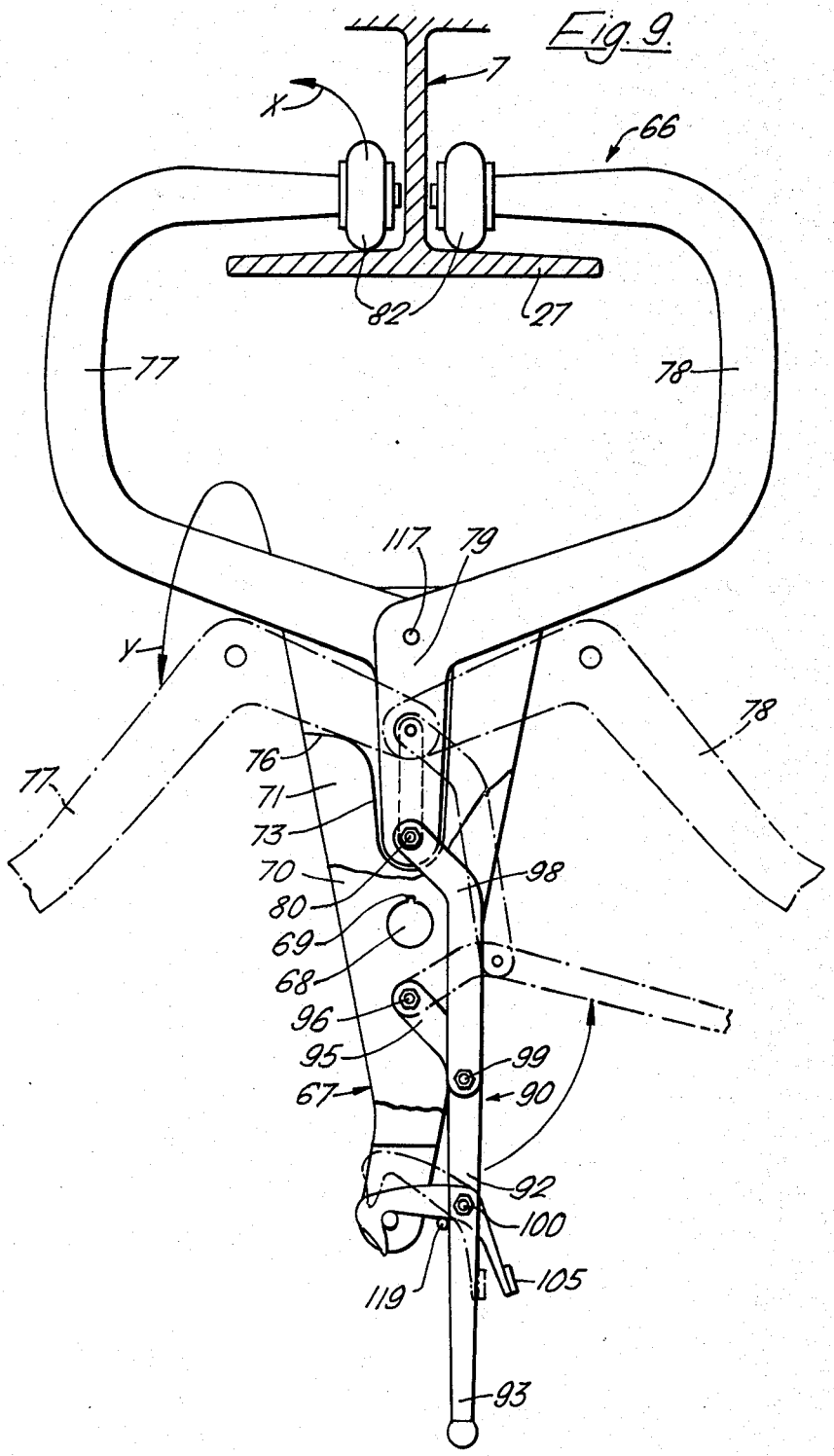
FIG. 9 is a front view of another form of roller assembly for a cradle embodying the invention.
Figure 10:
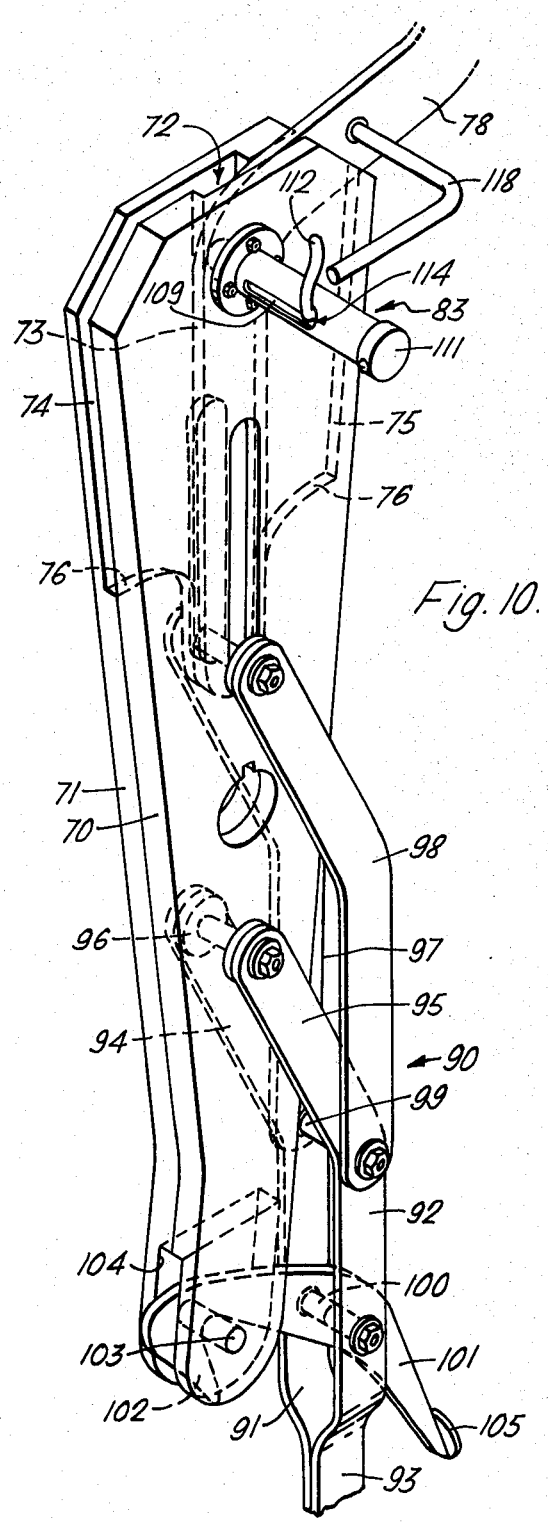
FIG. 10 is a partial perspective view of the roller assembly of FIG. 9.

As shown in FIGS. 9 and 10, the lever system 90 for displacing the pivot pin 80 comprises a pair of primary levers 91, 92 connected together at their lower ends to form an operating handle 93. The primary levers 91, 92 are cranked intermediate their ends so that upper portions 94, 95 of the levers embrace the block 67 to which they are pivotally connected by a non-displaceable pivot pin 96 extending through an appropriate bore in the block 67. A pair of secondary levers 97, 98 are articulated to the primary levers 91, 92 outside the respective primary levers by a lever link pin 99. The upper ends of the secondary levers 97, 98 are articulated to the opposite ends of the movable pivot pin 80.

Between the lever link pin 99 and the operating handle 93, the primary levers support a catch pivot pin 100 on which is pivotally mounted, between the primary levers 91, 92, a catch lever 101 having a hook 102 at one end. In the roller-applying condition of the roller assembly, the hook 102 is engaged over a fixed catch pin 103 provided in a small recess 104 defined at the bottom of the mounting block 67 between members 70, 71 to retain the lever system in the position shown in FIG. 10. The other end of catch lever 101 is provided with a pad 105 whereby the lever can be manipulated by a finger when holding operating handle 93 to release the lever system so that the rollers can be released.

Figure 11:
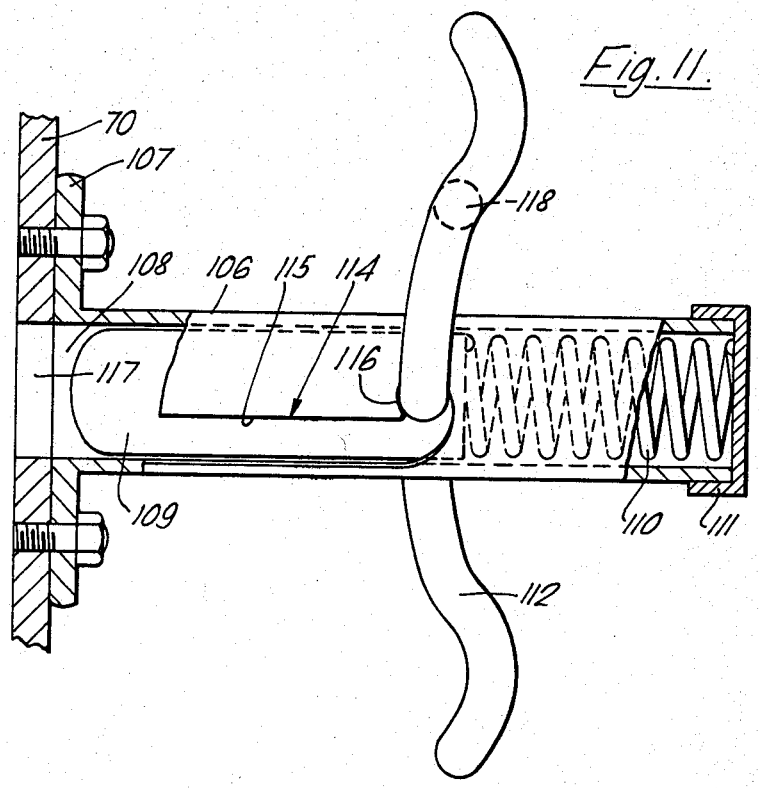
FIG. 11 is an enlarged side view of a locking device of the roller assembly of FIG. 9.
Figure 12:
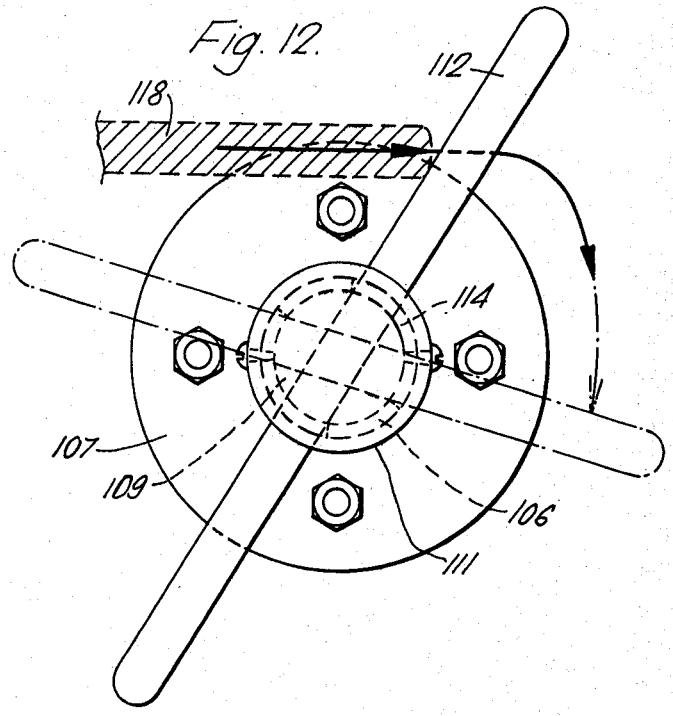
FIG. 12 is an end view of the locking device of FIG. 11.

The safety locking device 83 for locking the carrying arms 77, 78 is shown in FIGS. 11 and 12 and comprises a cylindrical casing 106 having a mounting flange 107 at an open end 108 for mounting the device on member 70. The casing 106 accommodates a locking bolt 109 biased towards the open end of the housing by a helical spring 110 disposed between the bolt 109 and a removable end cap 111 of the housing 106. Bolt 109 is provided with transversely projecting latching arms 112 which extend out of the casing 106 through bayonet type slots 114 in the casing, each slot 114 having a portion 115 extending longitudinally of the casing and a lateral end portion 116. By retracting the bolt 109 against the action of spring 110 to the end of the slots 114 and then rotating the bolt, the arms 112 may be latched in the inoperative position of FIG. 11.

The casing 106 is mounted on member 70 so that, with the carrying arms 77, 78 in their roller-applying position, the bolt 109 extends through a bore 117 formed by aligned apertures in members 70, 71 and arms 77, 78. In order to make the locking of the carrying arms 77, 78 automatic on their roller-applying position, one carrying arm may be provided with a trigger pin 118 arranged to strike a latching arm 112 of the bolt 109 during movement of the carrying arm to its roller-applying position, as shown in FIGS. 10 and 12.

In order to release a roller assembly for movement past an obstacle, the bolt 109 is first retracted and latched in its inoperative position. The catch lever 101 can then be disengaged by pressing on the pad 105 to disengage hook 102, whereupon the operating handle 93 can be pivoted laterally as shown in FIG. 9 to raise pivot pin 80 and separate the carrying arms 77, 78. To return the arms 77, 78 to their roller-applying position, the handle 93 is returned to its full line position in FIG. 9, the trigger pin 118 releasing the bolt 109 as it passes. A stop lug 119 is provided on the primary levers 91, 92 underneath the catch lever 101 to hold the catch lever 101 in the correct position during re-application of the rollers so that the lever 101 automatically engages pin 103 and latches the lever system at the end of the movement.

Although the invention has been described in connection with the inspection and maintenance of offshore oil rigs, it is envisaged that cradles embodying the invention will find application wherever suitable rails 7 form part of or can be provided on a structure to be inspected or maintained.

We claim:

1. A suspended cradle for use in the inspection and maintenance of difficulty accessible structures, said cradle including:

a frame;

a series of at least three roller assemblies mounted on said frame in horizontally spaced apart relation for suspending said frame from said structure;

each said roller assembly having rollers for running on a track provided on the structure to be inspected or maintained and thereby suspending said frame for movement along the track; and means for rendering each said roller assembly inoperative by relieving the load on the rollers of said assembly and withdrawing the rollers from the track so that the inoperative roller assembly can move past an obstruction on the track whilst the frame remains movably supported on the track by the remaining roller assemblies.

2. A suspended cradle as claimed in claim 1, wherein each roller assembly has a pair of rollers each for engaging a respective horizontal flange of an inverted T-shaped rail forming the track on the structure to be inspected or maintained, each roller being mounted on a carrying arm which is vertically displaceable relative to the frame for relieving the load on the roller and pivotable for withdrawing the roller transversely of the rail.

3. A suspended cradle as claimed in claim 2, wherein the carrying arms of each said roller assembly are pivotably connected to a load-relieving member which is vertically displaceable with respect to a stationary base member fixed to the frame for relieving the load on the rollers.

4. A suspended cradle as claimed in claim 3, wherein each carrying arm is provided, between the pivotal connection to the load-relieving member and the roller, with a sliding block articulated to a fixed lever carried by a movable arm-pivoting member which is mounted on the load-relieving member for vertical displacement relative thereto in order to pivot the carrying arm about its pivotal connection to the load-relieving member and thereby withdraw the roller from the rail.

5. A suspended cradle as claimed in claim 2, wherein said carrying arms of each said roller assembly are pivotally connected together by a pivot link, and a lever mechanism is provided for displacing said pivot link in order to release said rollers from the track.

6. A suspended cradle as claimed in claim 5, wherein said carrying arms of each said roller assembly extend into a recess in a base member fixed to said frame, said carrying arms being connected together in said base member recess by said pivot link which is captively retained in a slot extending through said base member for movement between a roller-applying position and a roller-releasing position, said base member recess having internal cam surfaces which pivot said carrying arms towards one another as said pivot link is moved from said roller-releasing position to said roller-applying position.

7. A suspended cradle as claimed in claim 5, including means for locking said carrying arms of each roller assembly together in the position of said carrying arms applying said rollers to the track.

8. A suspended cradle as claimed in claim 1, comprising first and second frames each provided with a respective series of roller assemblies for suspending the cradles from respective first and second parallel tracks on the structure to be inspected or maintained, and flooring extending between and supported by the two frames.

9. A suspended cradle as claimed in claim 1 comprising a first pair of vertical frames for suspension in spaced apart relationship from a first track in the structure to be maintained, a second pair of vertical frames for suspension alongside the first pair of frames in spaced apart relationship from a second parallel track on the structure, and flooring extending between and supported by the four frames.

10. A suspended cradle as claimed in claim 1, wherein the frame is of ladder-like construction having a plurality of vertically spaced apart horizontal bars for supporting flooring so that flooring may be supported between two frames in a substantially level condition when the frames are suspended from tracks at different heights in the structure to be inspected or maintained.

* * * * *